US006425958B1

(12) United States Patent
Giddings et al.

(10) Patent No.: US 6,425,958 B1
(45) Date of Patent: Jul. 30, 2002

(54) ALL SURFACE CLEANER

(75) Inventors: Daniel G. Giddings; Richard A. Diekema, both of Holland, MI (US)

(73) Assignee: Tennant Company, Minneapolis, MN (US)

( * ) Notice: Subject to any disclaimer, the term of this patent is extended or adjusted under 35 U.S.C. 154(b) by 0 days.

(21) Appl. No.: 09/777,837

(22) Filed: Feb. 6, 2001

Related U.S. Application Data

(60) Provisional application No. 60/248,120, filed on Nov. 13, 2000.

(51) Int. Cl.[7] ..... B08B 3/02; B08B 5/04

(52) U.S. Cl. ..... 134/21; 15/321; 15/345; 134/30

(58) Field of Search ..... 15/321, 345, 323; 134/21

(56) References Cited

U.S. PATENT DOCUMENTS 4,956,891 A 9/1990 Wulff

FOREIGN PATENT DOCUMENTS

CA 2242793 5/1999

OTHER PUBLICATIONS

Nobles, Typhoon 1610P/1612 Wet/Dry Vacuum Operator and Parts Manual, Jan. 2000, 22 pages Kaivac, Inc., Warning: Your Competitor has a KaiVac, Sep. 1998, 10 pages.

Kärcher, Multicleaner MC 600, Mar. 1990, 7 pages.

Kärcher, Worldwide Cleaning Expertise Programme 91/92, published more than one year prior to the filing date of the present application, 50 pages.

*Primary Examiner*—Chris K. Moore
(74) *Attorney, Agent, or Firm*—Price, Heneveld, Cooper, DeWitt & Litton

(57) ABSTRACT

A cleaning assembly for cleaning surfaces includes a tank and motor housing with a fluid pump assembly, a blower assembly and a vacuum assembly located within the tank and motor housing. The tank and motor housing is adapted to contain a fluid. The fluid pump assembly includes a pump motor configured to pump the fluid in the tank and motor housing through a sprayer hose and onto the surfaces. The blower assembly includes a blower motor configured to blow air through a blower hose and onto the surfaces for directing movement of the fluid on the surfaces. The vacuum assembly includes a recovery tank and a vacuum motor configured to vacuum the fluid with the vacuum motor off of the surfaces, through a separate vacuum hose and into the recovery tank for cleaning the surfaces.

34 Claims, 7 Drawing Sheets

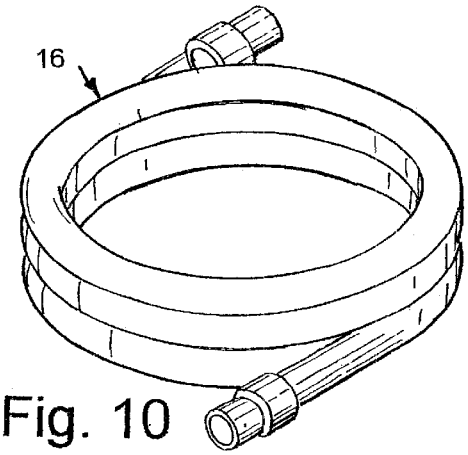
Fig. 10
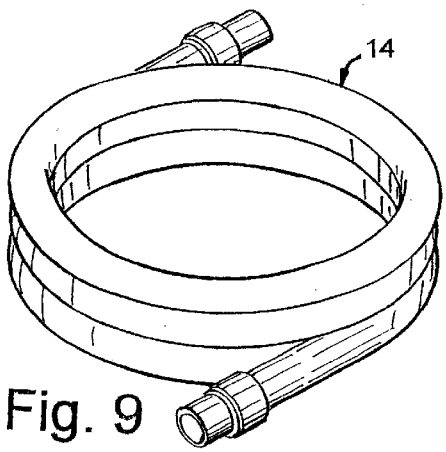
Fig. 9
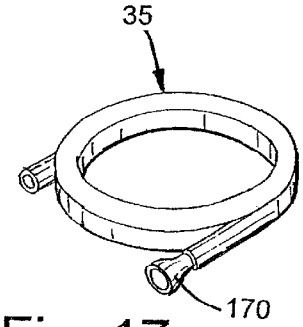
Fig. 17
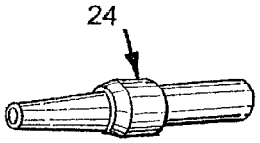
Fig. 12
Fig. 11
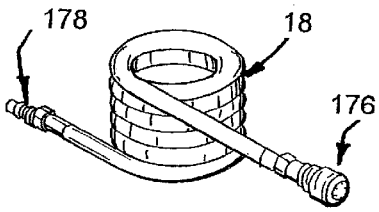
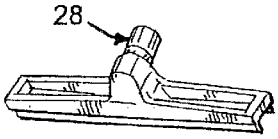
Fig. 14
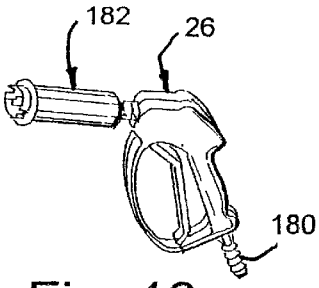
Fig. 13
Fig. 15
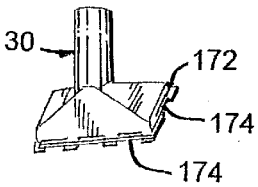
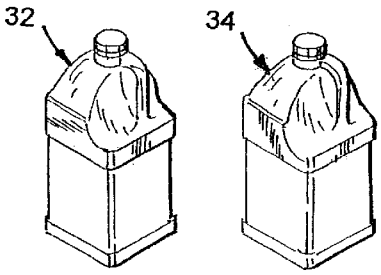
Fig. 16

ALL SURFACE CLEANER

CROSS-REFERENCE TO RELATED APPLICATION

This application claims priority under 35 U.S.C. §119(e) to U.S. Provisional Application Ser. No. 60/248,120 filed on Nov. 13, 2000 entitled ALL SURFACE CLEANER, the entire disclosure of which is incorporated herein by reference.

BACKGROUND OF THE INVENTION

The present invention relates to cleaning equipment, and more particularly to cleaning equipment for cleaning surfaces.

Cleaning equipment is used extensively for cleaning the surfaces of sinks, urinals, toilets, windows, shower stalls, tiles, stone, brick, locker rooms, swimming pool areas and other surfaces.

Heretofore, cleaning surfaces had included the steps of spraying a cleaning fluid onto the surfaces, blow drying the surfaces and/or vacuuming the fluid off of the surfaces. The cleaning equipment used in cleaning the surfaces typically included a single blower motor used for both vacuuming and blowing. The blower motor typically included an air intake and an air outlet. The cleaning equipment also typically included a tube configured to be connected to the air outlet of the vacuum motor for blow drying the surfaces and for pushing the fluids on the surfaces in a certain direction for later suctioning. The tube also can be connected to the air intake of the vacuum motor for suctioning the fluids off of the surfaces. However, the use of one blower and one tube for both blowing the surfaces and suctioning the fluids off of the surfaces can allow the surface to remain contaminated. Once the fluids are suctioned off of the surfaces, germs and bacteria in the fluid adhere to the side walls of the tube or the blower. Therefore, once the tube and the vacuum motor is used to vacuum off of the surfaces during a previous use, the germs and bacteria could be blown back onto the surfaces during drying. Consequently, the surfaces will typically always have some germs and bacteria as this cycle continues.

Accordingly, an apparatus solving the aforementioned disadvantages and having the aforementioned advantages is desired.

SUMMARY OF THE INVENTION

The present invention comprises a method for cleaning surfaces and a device used therein comprising a tank and motor housing with a fluid pump assembly, a blower assembly and a vacuum assembly located within the tank and motor housing. The tank and motor housing is adapted to contain a cleaning fluid. The fluid pump assembly includes a pump motor configured to pump the fluid in the tank and motor housing through a sprayer hose and onto the surfaces. The blower assembly includes a blower motor configured to blow air through a blower hose and onto the surfaces for directing movement of the fluid on the surfaces and drying the surfaces. The vacuum assembly includes a recovery tank and a vacuum motor configured to vacuum the fluid with the vacuum motor off of the surfaces, through a vacuum hose and into the recovery tank, thereby cleaning the surfaces.

The principal objects of the present invention include providing a cleaning device assembly for cleaning surfaces. The cleaning device assembly provides a safe and clean device for cleaning sinks, urinals, toilets, windows, shower stalls, tiles, stone, brick, locker rooms, swimming pool areas and other surfaces. The cleaning device assembly includes separate vacuum and blower assemblies, thereby preventing contamination of the two systems. The cleaning device assembly further includes separate vacuum and blower hoses for preventing contamination of the blower hose. The cleaning device assembly is efficient in use, economical to manufacture, capable of a long operable life, and particularly adapted for the proposed use.

These and other features, advantages, and objects of the present invention will be further understood and appreciated by those skilled in the art by reference to the following specification, claims and appended drawings.

BRIEF DESCRIPTION OF THE DRAWINGS

FIG. 9 is a perspective view of a vacuum hose embodying the present invention.

FIG. 10 is a perspective view of a b lower hose embodying the present invention.

FIG. 11 is a perspective view of a sprayer hose embodying the present invention.

FIG. 12 is a perspective view of a blower hose nozzle embodying the present invention.

FIG. 13 is a perspective view of a spray gun embodying the present invention.

FIG. 14 is a perspective view of a squeegee floor tool attachment embodying the present invention.

FIG. 15 is a perspective view of a gulper tool embodying the present invention.

FIG. 16 is a perspective view of a cleaner fluid container and a rinser fluid container embodying the present invention.

FIG. 17 is a perspective view of a tank fill hose embodying the present invention.

DETAILED DESCRIPTION OF THE PREFERRED EMBODIMENTS

Figure 1:
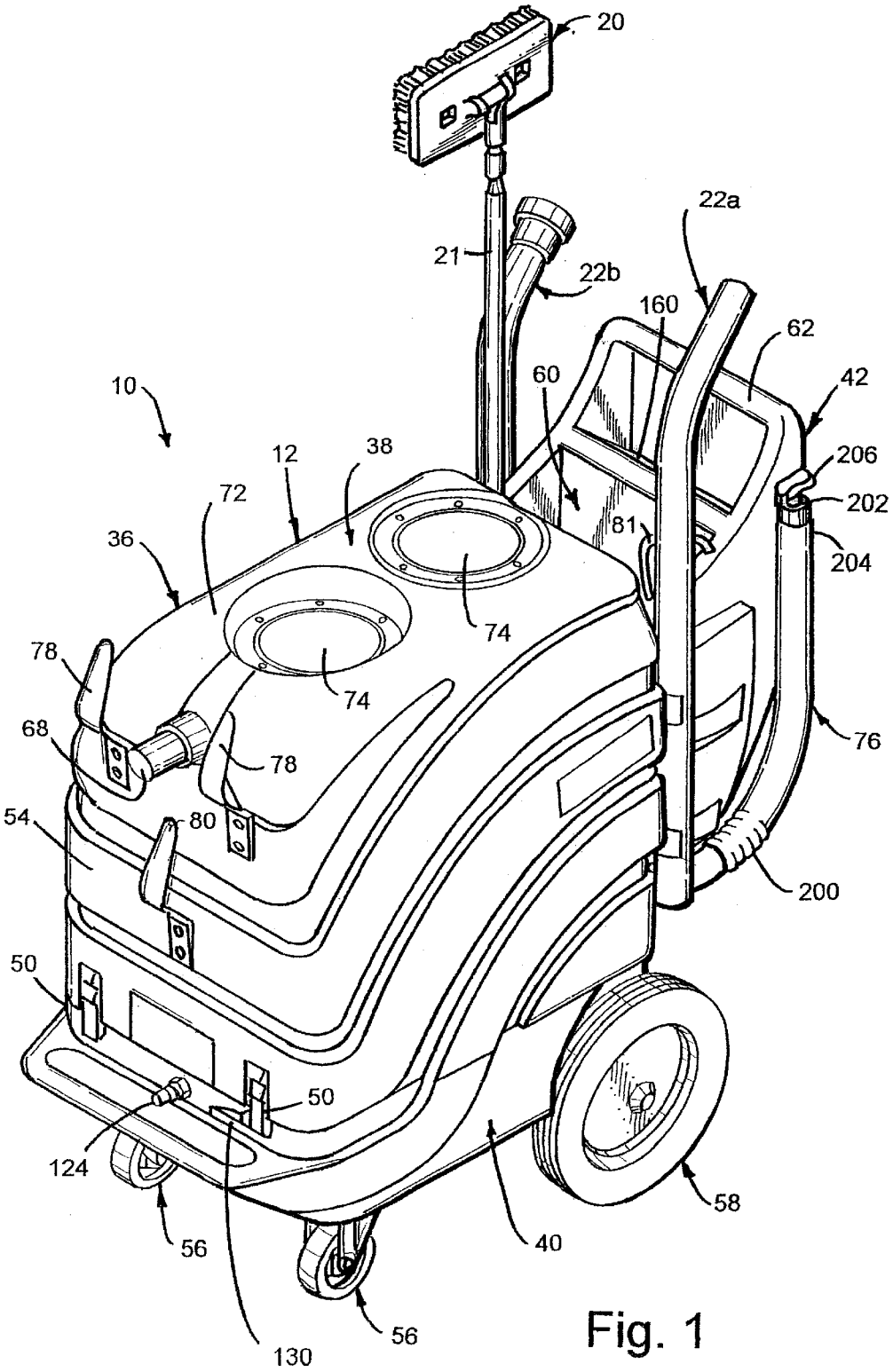
FIG. 1 is a front perspective view of a cleaning device assembly used for cleaning surfaces embodying the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be under stood that the specific devices and processes illustrated in the attache d drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Referring initially to FIG. 1, there is shown a cleaning assembly 10 embodying the present invention. The cleaning assembly 10 is preferably used to clean hard surfaces in restrooms or any other room having at least one hard surface. The illustrated cleaning assembly 10 includes a cleaning device 12 and the accessories used with the cleaning device 12 for cleaning the surfaces. The illustrated cleaning device 12 includes a vacuum hose 14 (FIG. 9), a blower hose 16 (FIG. 10) and a sprayer hose 18 (FIG. 11) used in cleaning the surfaces. The accessories include a floor brush 20 having a telescoping and extending handle 21, a first piece 22*a* and a second piece 22*b* of a two piece double bend wand, a blower hose nozzle 24 (FIG. 12), a spray gun 26 (FIG. 13), a squeegee floor tool attachment 28 (FIG. 14), a gulper tool 30 (FIG., 15), a cleaner fluid container 32, a rinser fluid container 34 (FIG. 16); and a tank fill hose 35 (FIG. 17). The cleaning device 12 is used to clean surfaces by spraying a cleaner fluid or a combination of the cleaner fluid and a rinser fluid through the sprayer hose 18 and onto the surfaces. The blower hose 16 is then used to blow dry the surfaces and to blow the fluid on the surfaces in a predetermined direction. Finally, the vacuum hose 14 is used to suction the fluid off of the surfaces and into the cleaning device 12, thereby cleaning the surfaces. As explained in more detail below, the vacuum hose 14, the blower hose 16, the sprayer hose 18 and the accessories are used with the cleaning device 12 for cleaning the surfaces and can be carried with the cleaning device 12 for easy transportation.

Figure 2:
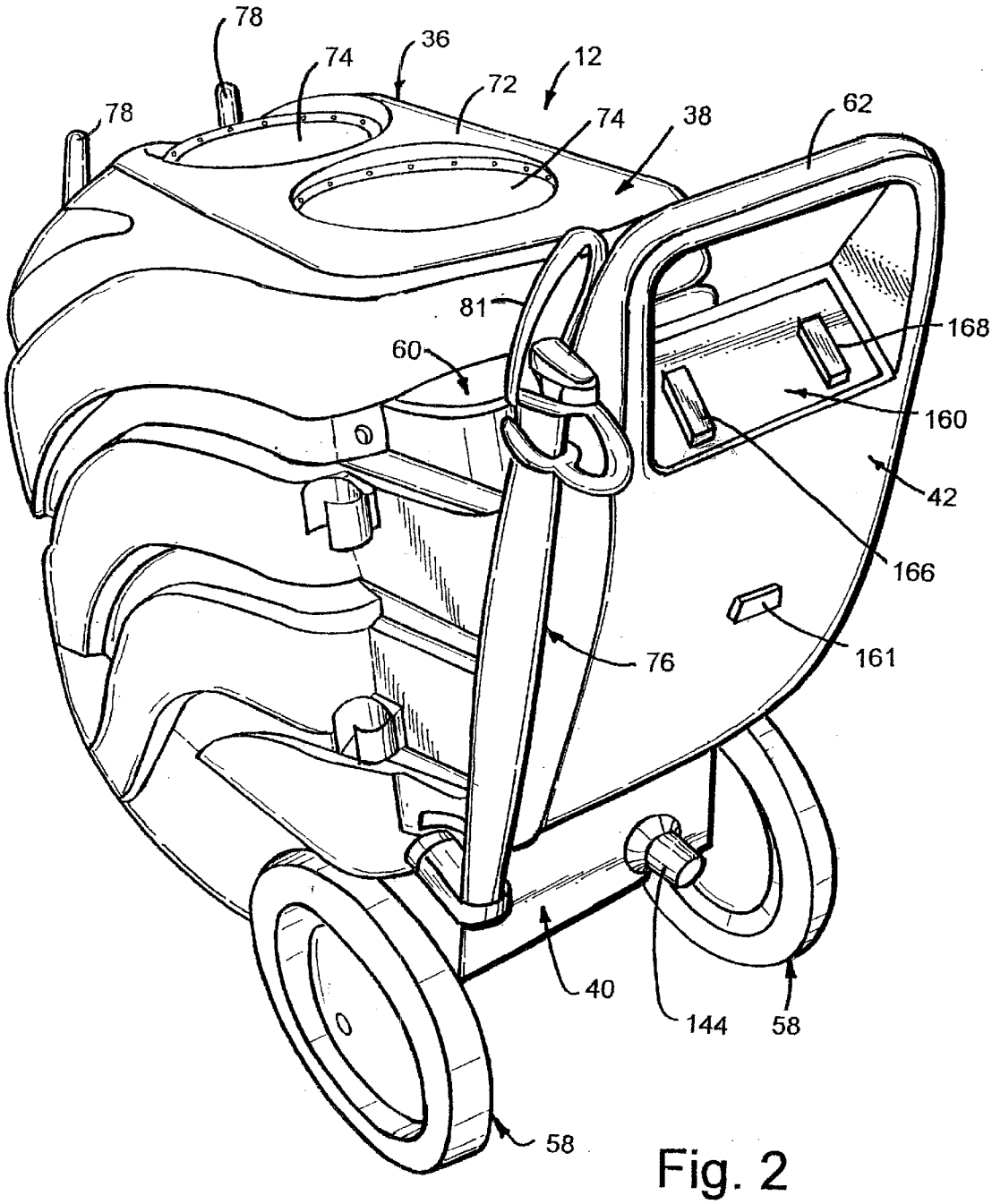
FIG. 2 is a rear perspective view of the cleaning device of the cleaning device assembly embodying the present invention.
Figure 3:
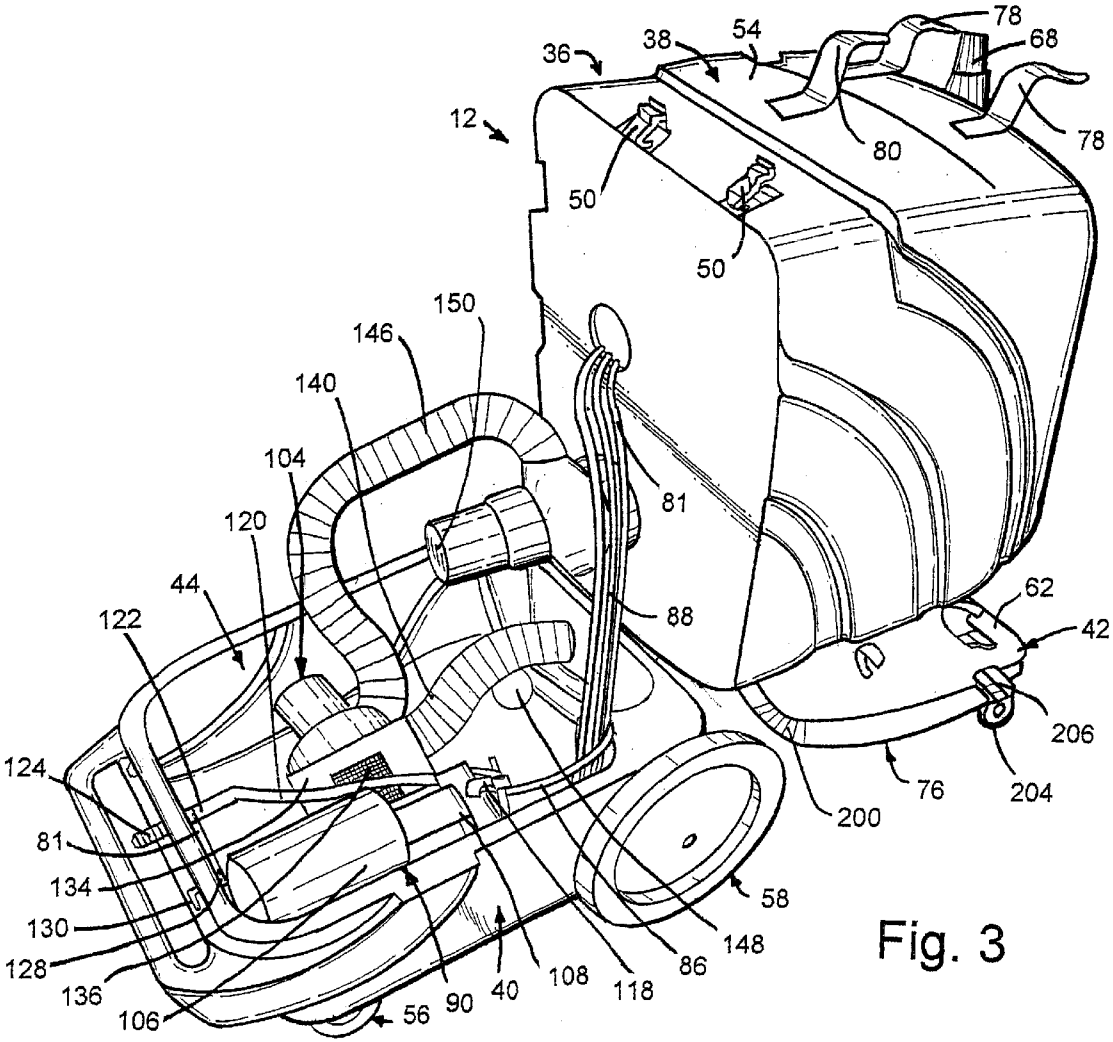
FIG. 3 is a perspective view of the cleaning device in an open position embodying the present invention.

The illustrated cleaning device 12 (FIGS. 1–3) comprises a tank and motor housing 36 having an upper housing 38, a lower housing 40 pivotally attached to the upper housing 38 and a handle 42 connected to the upper housing 38. The upper housing 38 is a substantially closed rectangular container and the lower housing 40 is a substantially rectangular shell having a cavity 44 with an open top (FIG. 3). A hinge 48 (FIG. 6) pivotally connects a rear lower edge of the upper housing 38 of the tank and motor housing 36 to a rear upper edge of the lower housing 40 of the cleaning device 12. The cleaning device 12 is in a closed position (FIG. 1) when the upper housing 38 is located directly above the cavity 44 of the lower housing 40. A pair of snap lock latches 50 attached to a lower portion of the upper housing 38 engages a pair of downwardly facing hooks 52 (FIG. 6) on the lower housing 40 for maintaining the cleaning device 12 in the closed position. The latches 50 are disengaged from the hooks 52 and the front surface 54 of the upper housing 38 is lifted to move the cleaning device 12 into an open position (FIG. 3) to expose the lower housing 40. The lower housing 40 also includes a pair of front wheels 56 configured to pivot about a vertical axis and a pair of rear wheels 58 for easily moving the tank and motor housing 36. The handle 42 has a substantially U-shaped cross section, with ends of the U-shaped cross section connected to the rear face of the upper housing 38. The interior of the U-shaped cross-section of the handle 42 slopes downwardly towards the rear face of the upper housing 38 to define an open-topped compartment 60. The handle 42 also includes an inverted U-shaped grip bar 62 extending from the top of the handle 42. The grip bar 62 is grasped by a user and pushed to move the tank and motor housing 36 with the front wheels 56 and the rear wheels 58.

The upper housing 38 (FIGS. 4 and 5) of the tank and motor housing 36 includes a first recessed opening 64, a second recessed opening 66, a vacuum fitting 68 and a drain hose fitting 70 opening into the interior of the upper housing 38. The first recessed opening 64 and the second recessed opening 66 are aligned front to back in the top surface 72 of the upper housing 38. Screw-on lids 74 located in the first recessed opening 64 and the second recessed opening 66 enclose the interior of the upper housing 38 from the surrounding environment. The vacuum fitting 68 comprises a cylindrical tube and extends from the front surface 54 of the upper housing 38. The vacuum fitting 68 is configured to be frictionally engaged with the vacuum hose 14 for connecting the vacuum hose 14 to the cleaning device 12. The drain hose fitting 70 is located in the bottom corner of the rear face of the upper housing (see FIGS. 2, 4 and 5). The drain hose fitting 70 is connected to a drain hose 76. As explained in more detail below, the drain hose 76 is used to evacuate fluid that is recovered from the surfaces from the interior of the upper housing 38. The upper housing 38 further includes a pair of vacuum hose hooks 78 extending outwardly and upwardly from an upper portion of the front surface 54 of the upper housing 38 on both sides of the vacuum tube fitting 68. The vacuum hose hooks 78 receive the vacuum hose 14 for easily transporting the vacuum hose 14 with the cleaning device 12. Likewise, a sprayer hose hook 81 extends outwardly and upwardly from a central portion of the front surface 54 of the upper housing 38 below the vacuum tube fitting 68 for receiving the sprayer hose 16 for transportation with the cleaning device 12.

Figures 4, 7, 8:
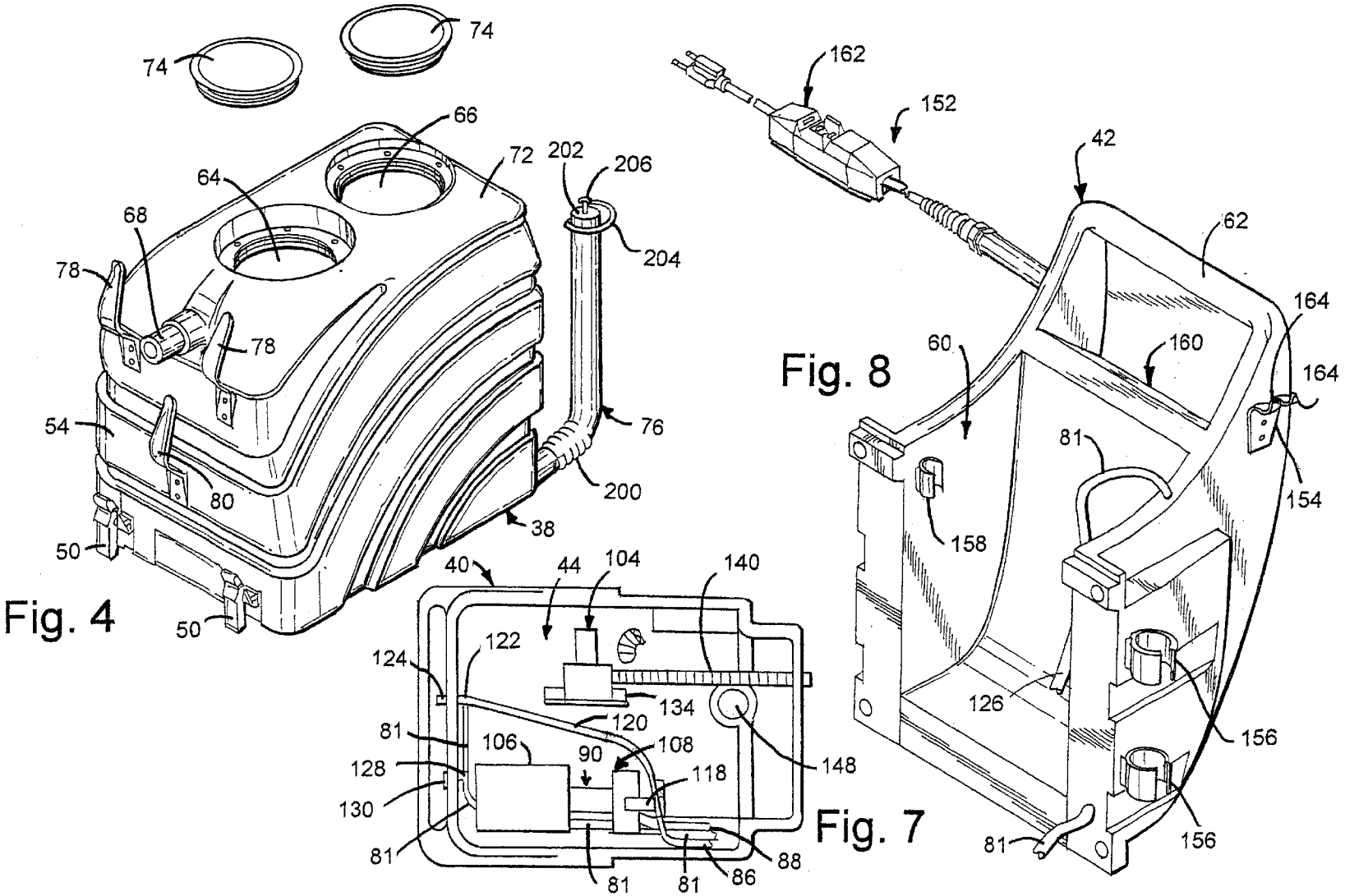
FIG. 4 is a perspective view of an upper housing of the cleaning device embodying the present invention.
FIG. 7 is a top view of the lower housing of the cleaning device embodying the present invention.
FIG. 8 is a perspective view of a handle of the cleaning device embodying the present invention.
Figure 5:
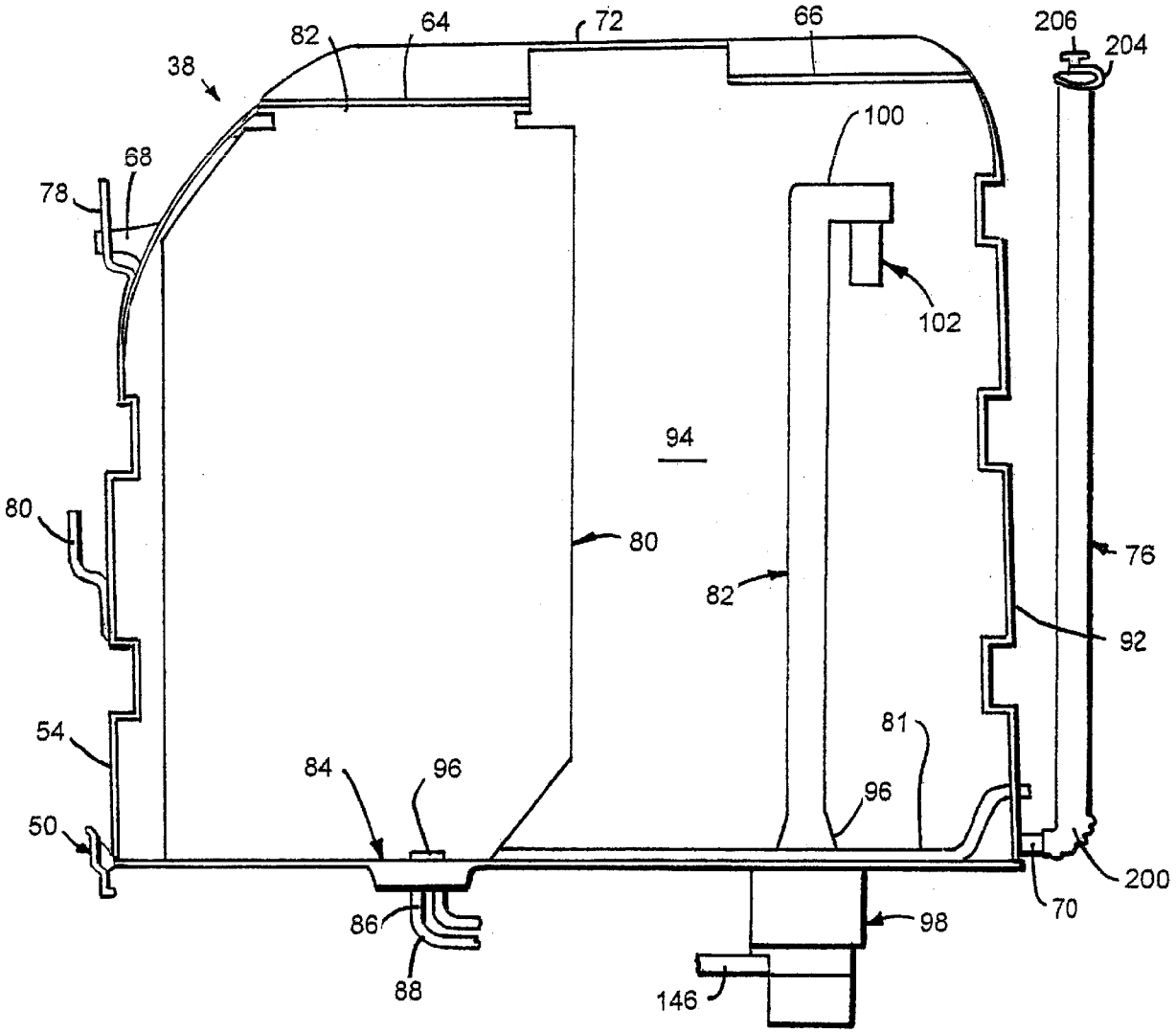
FIG. 5 is a side view of an upper housing of the cleaning device with a side wall removed embodying the present invention.

The upper housing 38 further includes a rinser fluid tank 80, a cleaner fluid tube 81 and an inverted L-shaped vacuum pipe 82 located in the interior of the upper housing (FIG. 5). The rinser fluid tank 80 is connected to the bottom face of the top surface 72 of the upper housing 38 and includes an annular top opening 82 that surrounds the first recessed opening 64. The rinser fluid tank 80 also includes a bottom opening 84 connected to a first pipe 86 and a second pipe 88 coupled with a pump motor 90 (FIGS. 3 and 7). As explained in more detail below, a rinser fluid is injected into the rinser fluid tank 80 through the first recessed opening 64 and thereafter pumped through the second pipe 88 to apply the rinser fluid to the surfaces. The rinser fluid tank 80 can have a rigid wall or a flexible wall. When a flexible wall is used for the rinser fluid tank 80, the internal volume of the rinser fluid tank 80 can shrink as the fluid is removed from the rinser fluid tank 80. A screen 96 is located over the bottom opening 84 in the rinser fluid tank 80 for stopping solid particles from entering the first pipe 86 and the second pipe 88. The cleaner fluid tube 81 extends from the open topped compartment 60 of the handle 42, through the handle 42 (FIG. 8), through a rear wall 92 of the upper housing 38, through a wall of the rinser fluid tank 80 and through the bottom opening 84 of the rinser fluid tank 80. As explained in more detail below, cleaner fluid is pumped through the cleaner fluid tube 81 to the lower housing 40 to be selectively mixed with the rinser fluid for cleaning the surfaces. The rinser fluid tank 80 is fluidly separated from the cleaner fluid tube 81 and the remaining interior of the upper housing 38. Therefore, the rinser fluid in the rinser fluid tank 80 cannot escape to the remainder of the interior of the upper housing 38. Furthermore, the rinser fluid tank 80 does not contact any of the side walls of the upper housing 38.

A recovery fluid tank 94 is defined by the interior of the upper housing 38 except for the area occupied by the rinser fluid tank 80 and the cleaner fluid tube 81. The inverted L-shaped vacuum pipe 82 extends upward from the bottom surface of the interior of the upper housing 38 in a location below the second recessed opening 66. A bottom end 96 of the vacuum pipe 82 is connected through an opening in the bottom surface of the upper housing 38 to a vacuum motor 98. A top end 100 of the vacuum pipe 82 opens into the recovery fluid tank 94. As explained in more detail below, the vacuum motor 98, when activated, will create a suction force through the vacuum fitting 68 in the front surface 54 of the upper housing 38 to suck the fluids on the surfaces into the recovery fluid tank 94. A shut-off float 102 is connected to the top end 100 of the vacuum pipe 82. The shut-off float 102 will turn off the vacuum motor 98 when it contacts fluid in the recovery fluid tank 94 so that the recovery fluid will not be sucked into the vacuum motor 98. If a flexible walled rinser fluid tank 80 is used, the volume of the recovery fluid tank 94 will enlarge as the fluid is removed from the rinser fluid tank 80.

Figure 6:
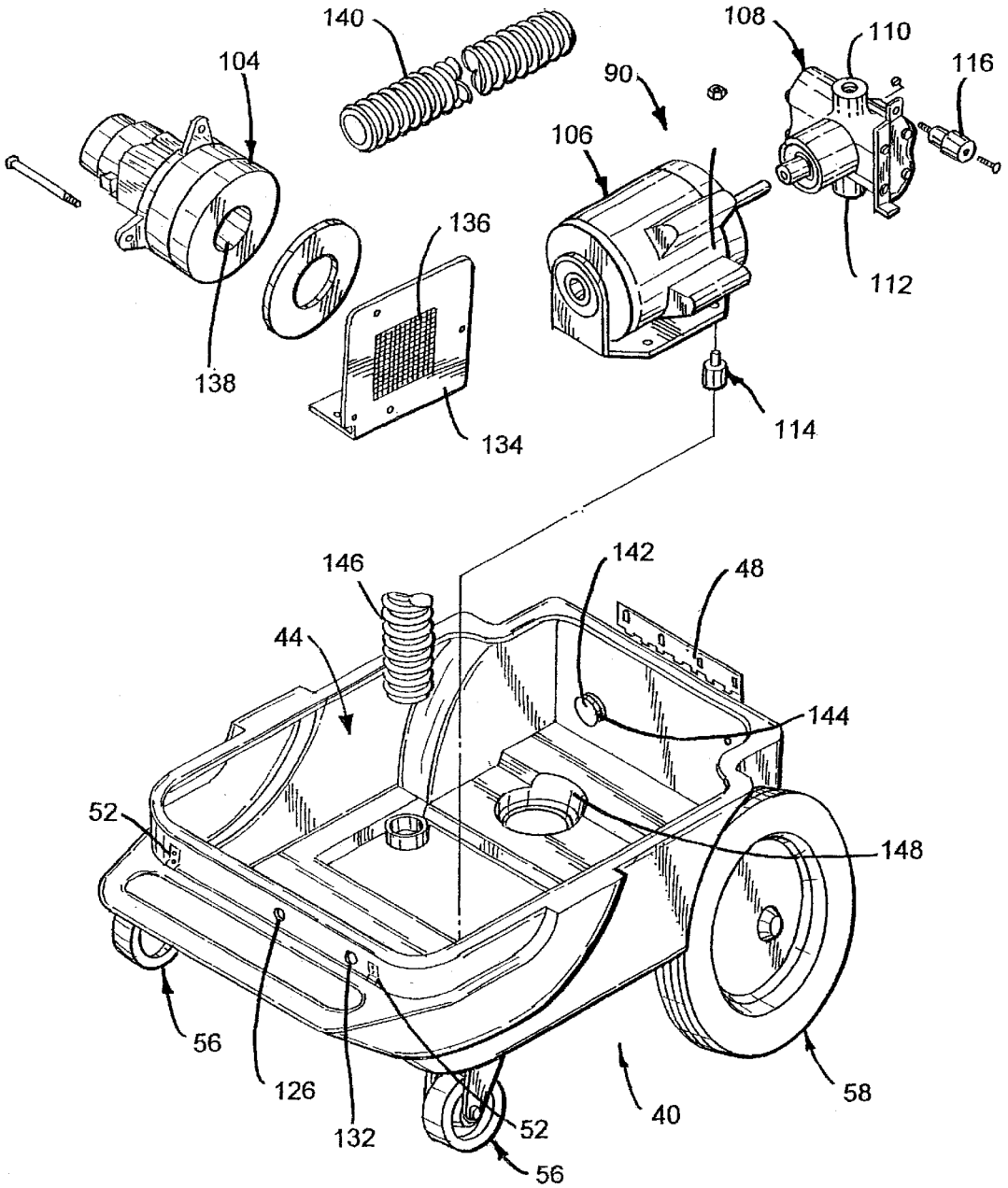
FIG. 6 is an explode d perspective view of a lower housing of the cleaning device embodying the present invention.

The lower housing 40 (FIGS. 3, 6 and 7) of the tank and motor housing 36 houses the pump motor 90, a pump hose 120 and portions of the cleaner fluid tube 81, first pipe 86 and the second pipe 88 within the cavity 44. The pump motor 90 includes a motor housing 106 for housing the motor of the pump motor 90 and a twin piston pump 108. The motor in the motor housing 106 drives the twin pistons in the twin piston pump 108. The motor housing 106 is suspended above the floor of the bottom housing 40 by a plurality of cylindrical mounts 114 (only one is shown in FIG. 6). Likewise, a cylindrical mount 116 connects the twin piston pump 108 to a side wall of the lower housing 40.

The illustrated twin piston pump 108 (see FIG. 6) includes a top opening 110 and a bottom opening 112. A suction force is created through the bottom opening 112 and push force is created through the top opening 110 of the twin piston pump 108. As seen in FIGS. 2 and 7, the top opening 110 of the twin piston pump 108 is fluidly connected to the first pipe 86 through a fitting 118. Furthermore, the bottom opening 112 of the twin piston pump 108 is fluidly connected to the second pipe 88. The first pipe 86 preferably has a smaller diameter than the second pipe 88. Therefore, the pump motor 90 will pump a fluid through the first pipe 86 to the rinser fluid tank 80 and the second pipe 88 will suck fluid from the rinser fluid tank 80 back to the pump motor 90. Since the first pipe 86 has a smaller diameter than the second pipe 88, a net amount of fluid will flow from the rinser fluid tank 80 to the pump motor 90.

Fitting 118 is attached to the twin piston pump 108 and is also connected to the pump hose 120. The net amount of fluid from the rinser fluid tank 80 described directly above is diverted through the fitting 118 and into the pump hose 120. The pump hose 120 extends from the fitting 118 connected to the twin piston pump 108 to an injector 122 connected to an interior surface of the front wall of the lower housing 40. A male fitting 124 located in an opening 126 in the front wall of the lower housing 40 is also connected to the injector 122. Therefore, fluid in the rinser fluid tank 80 is pushed by the pump motor 90 through the second pipe 88, into the twin piston pump 108, into the fitting 118, through the pump hose 120, into the injector 122 and into the male fitting 124 in the front wall of the lower housing 40. The male fitting 124 extends from the exterior of the front wall of the lower housing and is configured to be connected to the sprayer hose 18 for pumping the fluid from the rinser fluid tank 80 through the sprayer hose 18.

Cleaner fluid tube 81 extends through the cavity 44 of the lower housing 40 and is fluidly connected to the injector 122. The injector 122 siphons the cleaner fluid in the cleaner fluid tube 81 and joins the cleaner fluid with the fluid flowing through the pump hose 120. Preferably, the cleaner fluid container 32 is placed into the open-topped compartment 60 of the handle 42 and a first end 126 (FIG. 8) of the cleaning fluid tube 81 is inserted into the cleaner fluid container 32. When the pump motor 90 is started, fluid will flow through the pump hose 120, thereby creating a suction force in the cleaner fluid tube 81 because of the siphon characteristics of the injector 122. The cleaner fluid can therefore be pumped through the sprayer hose 18 with the fluid from the rinser fluid tank 80. As seen in FIGS. 1, 3 and 7, the cleaner fluid tube 81 is connected to a toggle valve 128 adjacent the front wall of the lower housing 40. The toggle valve 128 includes a handle 130 extending through an aperture 132 in the front wall of the lower housing 40. The handle 130 can be lifted away from the exterior of the front wall of the lower housing 40 to an off position wherein the flow of cleaner fluid through the toggle valve 128 and the cleaner fluid tube 81 is stopped. The handle 130 can also be pushed towards the exterior of the front wall of the lower housing 40 to an on position wherein the cleaner fluid is allowed to flow through the toggle valve 128 and the cleaner fluid tube 81. Therefore, when the handle 130 is moved to the off position, only the fluid from the rinser fluid tank 80 will flow through the injector 122 and the male fitting 124.

In the illustrated example, the lower housing 40 (FIGS. 2, 6 and 7) of the tank and motor housing 38 also includes a blower motor 104 within the cavity 44. An L-shaped bracket 134 attaches the blower motor 104 to the floor of the cavity 44 of the lower housing 40. The L-shaped bracket 134 includes a screen 136 for preventing solid particles from entering an air intake 138 of the blower motor 104. A flexible pipe 140 extends from the blower motor 104 to an opening 142 in the rear wall of the lower housing 40. As seen in FIGS. 2 and 7, the flexible pipe 140 is connected to a cylindrical fitting 144 extending through the opening 142 in the rear wall of the lower housing 40. The blower motor 104 sucks air in through the air intake 138 and blows the air through the flexible pipe 140 and out of the lower housing 40 through the cylindrical fitting 144. The cylindrical fitting 144 preferably includes a barbed outer surface outside of the lower housing 40. The cylindrical fitting 144 is configured to be engaged with the blower hose 16 for blowing air through the blower hose 16.

Lower housing 40 has an opening in the floor of the cavity 44 connected to an outlet pipe 146 for the vacuum motor 98 (FIGS. 3, 5 and 6). The outlet pipe 146 allows the air sucked by the vacuum motor 98 to exit through the floor of the cavity 44. The floor of the cavity 44 also includes an annular opening 148 for accepting a bottom end 150 of the vacuum motor 98 for accommodating the vacuum motor 98 in the cavity 44 when the cleaning device 12 is in the closed position. Handle 42 (FIGS. 1–3 and 8) includes the open-topped compartment 60, the cleaner fluid tube 81 and the grip bar 62 as described above. The handle 42 also includes a power cord 152, a drain hose bracket 154, a pair of wand clips 156 on each side of the handle 42, a brush clip 158, an operation dash 160 and an hour meter 161. The power cord 152 powers each of the motors in the cleaning device 12. The power cord 152 preferably includes a ground fault circuit interrupter 162 for protecting users of the cleaning device assembly 10 against electrical shock. The drain hose bracket 154 is attached to a side of the handle 42 and has a pair of prongs 164 extending away from the handle 42 for engaging the drain hose 76 and holding the drain hose 76 in an upright position. The wand clips 156 are U-shaped clips attached to each side of the handle 42. One pair of the wand clips 156 on one side of the handle is configured to hold the first piece 22*a* of the two piece double bend wand and another pair of wand clips 156 on the other side of the handle 42 is configured to hold the second piece 22*b* of the two piece double bend wand. The brush clip 158 is a U-shaped clip located in the compartment 60 of the handle 42. The brush clip 158 is configured to retain the floor brush 20 on the cleaning device 12. Therefore, the two piece double bend wand and the floor brush are retained by the handle 42 when not in use for easy transportation with the cleaning device 12. The operation dash 160 includes a first switch 166 having a position for powering the blower motor 104, a position for powering the vacuum motor 98 and an off position. The first switch 166 can therefore at a single time only select either the position for powering the blower motor 104 or the position for powering the vacuum motor 98. In the preferred embodiment of the cleaning assembly 10, the first switch 166 can only select one of the motors because of the power requirements of the preferred motors and the limitation currently available from a typical outlet. The operation dash 160 also includes a second switch 168 having a position for powering the pump motor 90 and an off position. The hour meter 161 is located below the operation dash 160 and indicates the amount of time that the pump motor 90 has been in use, and therefore allows a user of the cleaning device assembly 10 to schedule planned maintenance and monitor productivity. The blower hose nozzle 24, the spray gun 26, the squeegee floor tool attachment 28, the gulper tool 30, the cleaner fluid container 32, the rinser fluid container 34; and the tank fill hose 35 can be placed within the compartment 60 of the handle 42 when the cleaning assembly 10 is not in use for easy transportation of the accessories of the cleaning assembly 10. Furthermore, the sprayer hose 18 can be wrapped around the grip bar 62 of the handle 42 when not in use for easy transportation with the cleaning device 12.

The assembly 10 is used to clean surfaces by first placing the cleaner fluid container 32 in the compartment 60 of the handle 42. The cleaner fluid is preferably Formula 710 Multi-Surface Acid Cleaner sold by Tennant Inc. of Holland, Mich. The cleaner fluid tube 81 is then inserted into the cleaner fluid container 32. The cleaning device assembly 10 preferably includes metering tips that can be threaded onto the first end 126 of the cleaner fluid tube 81 in order to selectively meter the amount of cleaner fluid entering the cleaner fluid tube 81. Preferably, the metering tips have different colors representing different flow rates through the cleaner fluid tube 81. The metering tips preferably meter about 2 ounces of the cleaner fluid per gallon of rinser fluid for light cleaning, 4 ounces of the cleaner fluid per gallon of rinser fluid for medium cleaning and 6 ounces of the cleaner fluid per gallon of rinser fluid for heavy cleaning.

The rinser fluid tank 80 is thereafter filled with the rinser fluid by removing the lid 74 from the first recessed opening 64 and adding a selected amount of the rinser fluid from the rinser fluid container 34 into the rinser fluid tank 80. The rinser fluid is preferably added to the rinser fluid tank 80 according to dilution instructions on the rinser fluid container 34. The rinser fluid is preferably Formula 720 Multi-Surface Rinse sold by Tennant Inc. of Holland, Mich. The tank fill hose 35 is then connected to a source of water and the rinse fluid tank 80 is filled with water. The tank fill hose 35 preferably includes a fitting 170 that allows the tank fill hose 35 to be connected to most standard faucets. After the rinser fluid tank 80 is full of diluted rinser fluid, the lid 74 is replaced in the first recessed opening 64. The cleaning device assembly 10 is now ready for operation.

If the area having the surfaces to be cleaned is not equipped with a floor drain, the vacuum hose 14 is connected at one end to the vacuum fitting 68 and at the other end to the gulper tool 30. The gulper tool 30 includes a rectangular housing 172 that can be placed on the floor surface of the area. A plurality of openings 174 in the housing 172 allow fluid to enter the housing 172 when the gulper tool 30 is placed on the floor surface. The gulper tool 30 is preferably placed at a position where fluids in the room may puddle during operation of the cleaning assembly 10. When the vacuum motor 98 is activated, the gulper tool 30 will allow fluid on the floor to be sucked through the gulper tool 30, through the vacuum hose 14, through the vacuum fitting 68 and into the recovery fluid tank 94. Furthermore, once the vacuum motor 98 is activated, the gulper tool 30 will create a vacuum under the housing 172 of the gulper tool 30, thereby keeping the gulper tool 30 in position on the floor surface.

The sprayer tube 18 and the spray gun 26 are then connected to the cleaning device 12 before the surfaces are sprayed. The sprayer tube 18 (FIG. 11) preferably includes a female quick coupler 176 at one end of the sprayer tube 18. The female quick coupler 176 is engaged with the male fitting 124 extending from the front wall of the lower housing 40 of the cleaning device 12. The other end of the sprayer tube 18 includes a male quick coupler 178. The spray gun 26 (FIG. 13) is connected to the sprayer tube 18 by engaging a female quick coupler 180 on the spray gun 26 with the male quick coupler 178 on the sprayer tube 18. Therefore, the spray gun 26 is fluidly connected to the male fitting 124 extending from the front wall of the lower housing 40 of the cleaning device 12. The spray gun 26 also preferably includes a sliding nozzle 182 on the barrel of the spray gun 26 that allows the spray gun 26 to alternatively spray fluid at a high pressure thought the spray gun 26 or a low pressure through the spray gun 26. The sliding nozzle 182 preferably can be turned to customize the spray pattern of the fluid coming from the spray gun 26 between a fan pattern and a single beam.

Thereafter, the handle 130 extending from the front wall of the lower housing 40 of the tank and motor housing 36 is lifted away from the exterior of the front wall of the lower housing 40 to the on position. Consequently, as described above, the cleaner fluid coming from the cleaner fluid container 32 is allowed to flow through the toggle valve 128 and the cleaner fluid tube 81 to the male fitting 124 extending from the front wall of the lower housing 40, and therefore the spray gun 26.

The sliding nozzle 182 of the spray gun 26 is then moved to a low pressure spray position and the pump motor 90 is activated. Furthermore, if the area having the surfaces to be cleaned is not equipped with a floor drain, the vacuum motor 98 is activated for suctioning fluid off of the floor surface with the gulper tool 30. The spray gun 26 is then triggered to spray the surfaces in the room with a combination of the cleaner fluid and the rinser fluid. As described above, the cleaner fluid coming from the cleaner fluid container 32 through the cleaner fluid tube 81 and the toggle valve 128 and the rinser fluid coming from the rinser fluid tank 80, the second pipe 88, the twin piston pump 108 and the pump hose 120 will mix in the injector 122 when the handle 130 is in the on position. Thereafter, starting at the furthest point in the area, the surfaces are sprayed with a combination of the cleaner fluid and the rinser fluid with the spray gun 26. Vertical surfaces are preferably sprayed bottom to top working towards the cleaning device 12. After the surfaces have been sprayed, the pump motor 90 is turned off and the cleaner fluid and rinser fluid is allowed to work on the surfaces for a predetermined period of time. Furthermore, if the gulper tool 30 is being used, the vacuum motor 98 is turned off. Preferably, the combination of the cleaner fluid and the rinser fluid is allowed to work on the surfaces for 5–10 minutes. During this time, the floor brush 20 is preferably used to scrub corners and heavily soiled areas.

Once the cleaner fluid and the rinser fluid have worked on the surfaces, the handle 130 extending from the front wall of the lower housing 40 of the tank and motor housing 36 is pushed towards the exterior of the front wall of the lower housing 40 to the off position. Consequently, as described above, the cleaner fluid coming from the cleaner fluid container 32 is not allowed to enter the sprayer tube 18. Furthermore, when the handle 130 is moved to the off position, a fluid path will be provided between the second pipe 88 and the first pipe 86 so that the maximum pressure available to the spray gun 26 is regulated such that the spray gun 26 can be used again without a delay while the pressure is maintained within the sprayer tube 18 and cleaner fluid tube 81.

The sliding nozzle 182 of the spray gun 26 is then moved to the high pressure spray position and the pump motor 90 is activated. Once again, the vacuum motor 98 is activated if the area being cleaned does not include a drain. The spray gun 26 is then activated to spray only the rinser fluid on the surfaces. The spray gun 26 is preferably orientated such that the surfaces are sprayed from top to bottom. The rinser fluid preferably washes the fluids on the surfaces off of the surfaces such that no streaks occur on the surfaces.

After all of the surfaces have been rinsed with the rinser fluid, the pump motor 90 and the vacuum motor 98 are deactivated. The blower hose 16 is then connected at one end to the barbed outer surface of the cylindrical fitting 144 extending from the lower housing 40 of the tank and motor housing 36. The blower hose nozzle 24 (FIG. 12) is then attached to the other end of the blower hose 16. The blower motor 104 is then activated and the surfaces are blow dried with the air coming from the blower motor 104. Furthermore, the rinser fluid is preferably pushed to the floor surface with the air coming through the blower hose 24 and the blower hose nozzle 24. Once all of the wall surfaces are dry, the blower motor 104 is turned off. The fluid on the floor surfaces is preferably vacuumed up with the squeegee floor tool attachment 28 (FIG. 14). The squeegee floor tool attachment 28 is used by first connecting the first piece 22*a* and the second piece 22*b* of a two piece double bend wand together. One end of the two piece double bend wand is then connected to the squeegee floor tool attachment 28 and the other end of the double bend wand is connected to the vacuum hose 14. The vacuum motor 98 is then activated to suction the fluid off of the floor surface and into the recovery fluid tank 94 with the squeegee floor tool attachment 28. After all of the fluid is vacuumed up with the squeegee floor tool attachment 28, the vacuum motor 98 is turned off.

In the preferred embodiment, the recovery fluid tank 94 can be drained through the drain hose fitting 70 and the drain hose 76. As explained above, the drain hose fitting 70 is located in the bottom corner of the rear face of the upper housing 38. Therefore, the drain hose fitting 70 connects the drain hose 76 to the recovery fluid tank 94. The drain hose 76 includes a flexible portion 200 adjacent to the drain hose fitting 70. The flexible portion 200 allows the drain hose 76 to be lowered for emptying the recovery fluid tank 94 and raised for engagement with the drain hose bracket 152 on the handle 42. The drain hose 76 also includes a plug 202, a strap 204 and a T-shaped knob 206 adjacent a second end of the drain hose 76. The plug 202 is inserted into the second end of the drain hose 76 for closing the drain hose 76. The T-shaped knob 206 is screwed into the plug 202 for keeping the plug 202 within the drain hose 76, and the T-shaped knob 206 is screwed out of the plug 202 for allowing the plug to be removed from the drain hose 76. The strap 204 keeps the plug 202 and the T-shaped knob 206 connected to the drain hose 76. When the drain hose 76 is not in use, the T-shaped knob 206 of the drain hose 76 is inserted between the pair of prongs 164 of the drain hose bracket 152 on the handle 42 for maintaining the drain hose near the handle 42. If the vessel for depositing the fluid in the recovery fluid tank 94 is located at a vertical position below the recovery fluid tank 94, the plug 202 is removed from the drain hose 76 and the drain hose 76 is lowered into the vessel. The recovery fluid tank 94 then drains because the fluid will flow into the vessel because of gravity. If the vessel for depositing the fluid in the recovery fluid tank 94 is located at a vertical position above the recovery fluid tank 94, the blower hose 16 is connected at one end to the vacuum fitting 68 and at the other end to the cylindrical fitting 144 in the rear of the lower housing 40. The blower motor 104 is then activated to pressurize the fluid recovery tank 94 and push the fluid through the drain hose 76.

Since the cleaning device assembly 10 includes a vacuum motor 98 separate from the blower motor 104, only one vacuum motor is used for both vacuuming fluids off of the surfaces and for blow drying the surfaces. Therefore, germs and bacteria vacuumed off of the surfaces with the vacuum motor 98 will not later be blown onto other surfaces with the vacuum motor 98. The blower motor 104 should therefore remain relatively free of germs and bacteria during consecutive uses of the cleaning device assembly. Furthermore, separate vacuum and blower hoses help to keep the germs and bacteria from returning to the surfaces. Preferably, the vacuum hose 14 and the blower hose 16 have a different size and/or color so the two hoses will not be inadvertently used for the wrong function. Moreover, the blower motor 104 and the vacuum motor 98 will not function simultaneously because the first switch 166 only allows one to work at a time, thereby further protecting the cleaning device assembly 10 from contamination. Furthermore, the vacuum hose 14 preferably has a 1.5 inch diameter and the vacuum motor 98 preferably comprises a three stage vacuum pump for optimal suction. Another advantage of the disclosed cleaning device assembly, the use of a flexible walled fluid rinser tank 80 allows the cleaning device assembly 10 to have a compact design because the fluid rinser tank 80 will shrink as the fluid is removed from therein, thereby allowing the recovery fluid tank 94 to have a small initial volume. Since the internal volume of the recovery fluid tank 94 will enlarge as needed, the rigid walls of the recovery fluid tank 94 can have a small size, thereby allowing the cleaning device assembly 10 to have a small design.

In the forgoing description, it will be readily appreciated by those skilled in the art that modifications may be made to the invention without departing from the concepts disclosed herein. For example, the cleaning device assembly could include a carpet cleaning accessory adapted to be connected to both the vacuum hose 16 and the sprayer hose 18 such that a carpet could be simultaneously sprayed with a carpet cleaner and vacuumed. Furthermore, it is contemplated that the rinser fluid in the rinser fluid tank 90 could comprise water. Such modifications are to be considered as included in the following claims, unless these claims by their language expressly state otherwise.

We claim:

1. A cleaning device assembly for cleaning surfaces comprising:

a tank and motor housing adapted to contain a fluid;

a fluid pump assembly located within said tank and motor housing, said fluid pump assembly including a pump motor configured to pump the fluid in said tank and motor housing through a sprayer hose and onto the surfaces;

a blower assembly located within said tank and motor housing, said blower assembly including a blower motor configured to blow air through a blower hose and onto the surfaces for directing movement of the fluid on the surfaces;

a vacuum assembly located within said tank and motor housing, said vacuum assembly including a recovery tank and a vacuum motor configured to vacuum the fluid with said vacuum motor off of the surfaces, through a vacuum hose and into said recovery tank, thereby cleaning the surfaces.

2. The cleaning device as set forth in claim 1, wherein:

said tank and motor housing includes an hour meter for recording the total hours of use of the cleaning device.

3. The cleaning device as set forth in claim 2, wherein:

said tank and motor housing includes wheels for easily moving said tank and motor housing.

4. The cleaning device as set forth in claim 1, wherein:

said tank and motor housing includes a drain hose fluidly connected to said recovery tank for draining fluid from said recovery tank.

5. The cleaning device as set forth in claim 4, wherein:

said drain hose is configured to be fluidly connected to said blower motor for blowing said fluid from said recovery tank through said drain hose.

6. The cleaning device as set forth in claim 1, wherein:

said tank and motor housing includes a tool compartment housing for holding accessories used with said cleaning device;

said tool compartment housing including a power switch for powering said pump motor, said vacuum motor and said blower motor.

7. The cleaning device as set forth in claim 1, wherein:

said vacuum hose has a 1.5 inch diameter.

8. The cleaning device as set forth in claim 1, wherein:

said vacuum motor comprises a three stage motor.

9. The cleaning device as set forth in claim 1, wherein:

said fluid pump assembly includes a fluid tank adapted to hold a rinser fluid, a cleaner fluid hose adapted to be inserted into a container holding a cleaner fluid, and an injector fluidly connected to said fluid tank and said cleaner fluid hose for mixing the rinser fluid and the cleaner fluid in said tank and motor housing to form the fluid.

10. The cleaning device as set forth in claim 1, wherein:

said fluid pump assembly includes a fluid tank adapted to hold the fluid, said fluid tank being fluidly connected to said pump motor;

wherein said pump motor is configured to pump the fluid in said fluid tank through the sprayer hose and onto the surfaces.

11. The cleaning device as set forth in claim 10, wherein:

said fluid tank has flexible and collapsible walls.

12. A cleaning device assembly for cleaning surfaces comprising:

a tank and motor housing adapted to contain a fluid;

a sprayer hose connectable to said tank and motor housing;

a spray gun removably connected to said sprayer hose;

a fluid pump assembly located within said tank and motor housing, said fluid pump assembly including a pump motor configured to pump the fluid in said tank and motor housing through said sprayer hose, through said spray gun and onto the surfaces;

a blower hose connectable to said tank and motor housing;

a blower assembly located within said tank and motor housing, said blower assembly including a blower motor configured to blow air through said blower hose and onto the surfaces for directing movement of the fluid on the surfaces;

a vacuum hose connectable to said tank and motor housing; and a vacuum assembly located within said tank and motor housing, said vacuum assembly including a recovery tank and a vacuum motor configured to vacuum the fluid with said vacuum motor off of the surfaces, through said vacuum hose and into said recovery tank, thereby cleaning the surfaces.

13. The cleaning device assembly as set forth in claim 12, wherein:

said spray gun includes a nozzle having a first position for high powered spray and a second position for low powered spray.

14. The cleaning device assembly as set forth in claim 12, wherein:

said tank and motor housing includes an hour meter for recording the total hours of use of the cleaning device.

15. The cleaning device assembly as set forth in claim 14, wherein:

said tank and motor housing includes wheels for easily moving said tank and motor housing.

16. The cleaning device assembly as set forth in claim 12, wherein:

said tank and motor housing includes a drain hose fluidly connected to said recovery tank for draining the fluid from said recovery tank.

17. The cleaning device assembly as set forth in claim 16, wherein:

said drain hose is configured to be fluidly connected to said blower motor for blowing said fluid from said recovery tank through said drain hose.

18. The cleaning device assembly as set forth in claim 17, further including:

a gulper tool configured to be connected to said tank and said vacuum motor through said vacuum hose for vacuuming water off of the surfaces while said pump motor is spraying the fluid through said sprayer hose, through said sprayer gun and onto the surfaces.

19. The cleaning device assembly as set forth in claim 12, wherein:

said tank and motor housing includes a tool compartment for holding accessories used with said cleaning device assembly;

said tool compartment including a power switch for powering said pump motor, said vacuum motor and said blower motor.

20. The cleaning device assembly as set forth in claim 12, wherein:

said vacuum hose has a 1.5 inch diameter.

21. The cleaning device assembly as set forth in claim 20, wherein:

said vacuum motor comprises a three stage motor.

22. The cleaning device assembly as set forth in claim 12, wherein:

said fluid pump assembly includes a fluid tank adapted to hold a rinser fluid, a cleaner fluid hose adapted to be inserted into a container holding a cleaner fluid, and an injector fluidly connected to said fluid tank and said cleaner fluid hose for mixing the rinser fluid and the cleaner fluid in said tank and motor housing to form the fluid.

23. The cleaning device assembly as set forth in claim 22, further including:

a first tank fill hose for connecting said fluid tank to a supply of water for adding water to said fluid tank.

24. The cleaning device assembly as set forth in claim 22, wherein:

said tank and motor housing includes a cleaner fluid toggle valve having an off position and an on position;

said off position of said cleaner fluid toggle valve moving said injector to an off position wherein the cleaner fluid does not mix with the rinser fluid; and said on position of said cleaner fluid toggle valve moving said injector to an on position wherein the cleaner fluid mixes with the rinser fluid.

25. The cleaning device assembly as set forth in claim 12, wherein:

said fluid pump assembly includes a fluid tank adapted to hold the fluid, said fluid tank being fluidly connected to said pump motor;

wherein said pump motor is configured to pump the fluid in said fluid tank through the sprayer hose and onto the surfaces.

26. The cleaning device as set forth in claim 25, wherein:

said fluid tank has flexible and collapsible walls.

27. A method of cleaning surfaces comprising:

providing a tank and motor housing with a pump motor, a blower motor, a vacuum motor and a recovery tank;

inserting a fluid in said tank and motor housing;

pumping said fluid in said tank and motor housing through a sprayer hose and onto said surfaces with said pump motor;

blowing air through a blower hose and onto said surfaces with said blower motor;

directing said fluid on said surfaces with said air from said blower hose;

vacuuming said fluid with said vacuum motor off of said surfaces, through a vacuum hose and into said recovery tank.

28. The method of cleaning surfaces as set forth in claim 27, further including:

connecting a spray gun to said sprayer hose.

29. The method of cleaning surfaces as set forth in claim 27, further including:

recording the total hours of use of at least one of said pump motor, said blower motor and said vacuum motor with an hour meter.

30. The method of cleaning surfaces as set forth in claim 27, further including:

draining said recovery tank with a drain hose fluidly connected to said recovery tank.

31. The method of cleaning surfaces as set forth in claim 30, wherein:

said step of draining said recovery tank includes the steps of:

fluidly connecting said drain hose to said blower motor; and blowing said fluid from said recovery tank through said drain hose.

32. The method of cleaning surfaces as set forth in claim 27, further including:

fluidly connecting a gulper tool to said vacuum motor through said vacuum hose for vacuuming water off of said surfaces during said step of pumping said fluid.

33. The method of cleaning surfaces as set forth in claim 27, further including:

providing said tank and motor assembly with a fluid tank, a cleaner fluid hose and an injector;

inserting a rinser fluid into said fluid tank;

inserting said cleaner fluid hose into a container holding a cleaner fluid;

mixing said rinser fluid and said cleaner fluid in said tank and motor housing with said injector to form said fluid.

34. The method of cleaning surfaces as set forth in claim 33, wherein:

said step of inserting rinser fluid into said fluid tank includes the step of connecting a first tank fill hose to a supply of water.

* * * * *